United States Patent [19]

Goto et al.

[11] Patent Number: 4,516,978

[45] Date of Patent: May 14, 1985

[54] COLORED CHARACTER PRINTED ON KEY BUTTON

[75] Inventors: Hideo Goto; Takeo Hosoe; Toshinori Oda; Sosuke Ohtsuka, all of Nagoya, Japan

[73] Assignee: Brother Kogyo Kabushiki Kaisha, Nagoya, Japan

[21] Appl. No.: 533,573

[22] Filed: Sep. 19, 1983

[30] Foreign Application Priority Data

Sep. 29, 1982 [JP] Japan ..... 57-170577

[51] Int. Cl.[3] ..... H01H 13/14

[52] U.S. Cl. ..... 8/510; 8/513; 8/514; 8/562; 8/607; 8/654; 8/657

[58] Field of Search ..... 8/510, 513, 514, 607, 8/657, 562

[56] References Cited

U.S. PATENT DOCUMENTS 4,451,264 5/1984 Ulry et al. ..... 8/508

OTHER PUBLICATIONS

H-K. Dien in Venkataraman's "The Chemistry of Synthetic Dyes," vol. VIII, (Academic Press, 1978), (pp. 82-83, 100 and 128-129).

*Primary Examiner*—A. Lionel Clingman

*Attorney, Agent, or Firm*—Moonray Kojima

[57] ABSTRACT

A key button molded of a synthetic resin and having on the top surface thereof a character or symbol printed with a coloring agent comprising a dye and a solvent which is capable of dissolving the dye and the synthetic resin, wherein the character or symbol is durably formed on the top surface by the action of the solvent on the surface and body to cause the dye to permeate the surface and the body.

7 Claims, 9 Drawing Figures

COLORED CHARACTER PRINTED ON KEY BUTTON

BACKGROUND OF THE INVENTION

1. Field of Invention

This invention relates to a key button which is used for a keyboard of the like.

2. Discussion of the Prior Art

A conventional key button used for a keyboard of the like, are usually formed by molding a synthetic resin. When it is necessary to provide the key button with a character or a symbol on the working surface thereof, in one method, the character or symbol is printed on the working surface using an ink. In another method, the key button and character or symbol, are formed by a two color molding process or an injection molding process, wherein two synthetic resins of different colors are used to form the button and the character or symbol respectively. However, disadvantageously, in the first method, such a printed character or symbol is readily worn away or tends to become thin and finally unidentifiable after extended use. In the second method although the character or symbol do not tend to become worn or unidentifiable with use, disadvantageously, these methods require expensive molds for fabrication of such key button, and particularly, when molding the characters "O", "Q" and "6", complex molds are required.

Thus, there is a need for an inexpensive, reliable and simple method of manufacture of key buttons having characters or symbols on the working surface thereof.

SUMMARY OF THE INVENTION

Accordingly, an object of the invention is to eliminate and overcome the aforementioned and other disadvantages and deficiencies of the prior art.

Another object is to provide a key button having a character or a symbol provided on the surface thereof which will not wear out or become easily unidentifiable with use.

A further object is to provide a key button having a character or symbol on the top surface thereof which is inexpensive to manufacture.

A still further object is to provide a key button which can be manufactured simply, and at a reduced cost.

According to the present invention, there is provided a key button which is molded of a synthetic resin and provided on the working surface thereof with a character of symbol printed thereon with a coloring agent comprising a dye and a solvent, which is capable of dissolving the synthetic resin, wherein the character or symbol is formed on the working surface by action of the solvent dissolving suitably the surface and body structure thereby causing the dye to permeate the key button through the working surface.

In accordance with the present invention, there is also provided a process of manufacturing a key button comprising the steps of forming the body of a key button by molding a synthetic resin; printing a character or symbol on the working surface of the body with a coloring agent comprising a dye and a solvent which is capable of dissolving the synthetic resin, whereby the solvent acts on the synthetic resin through the surface and enables the dye to permeate the body of the key button. Then, the body having the permeated dye therein is left to stand at room temperature to dry. Advantageously, the molecules of the dye bond together with each other and with the molecules of the synthetic resin.

In the foregoing manner, the character or symbol is thus an integral part of the structure of the key button and its working surface. Accordingly, the symbol or character will not readily wear away with use. Also, the manufacture is simple and inexpensive.

DETAILED DESCRIPTION OF PREFERRED EMBODIMENTS

Figure 1:
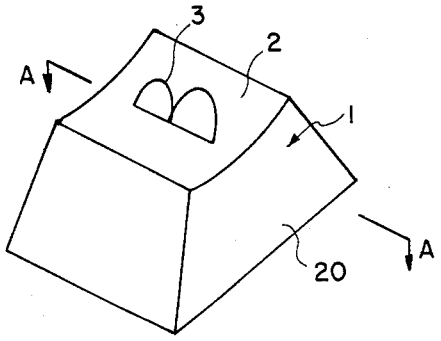
FIG. 1 is a perspective view of an illustrative embodiment of the invention.
Figure 2:
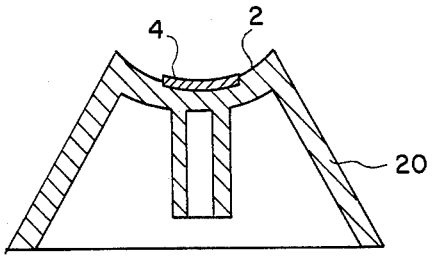
FIG. 2 is a sectional view taken along line A—A of FIG. 1.

Referring to FIGS. 1 and 2, which depict an illustrative embodiment of the invention, body 20 of a key button 1 is formed by suitably molding a synthetic resin, such as, for example, a resin of acrylonitrile-butadiene-styrene (ABS). A pattern of a character or symbol, is printed in and on top surface 2, which may also be referred to as working surface, since when the button is operated the top or working surface 2 is depressed by a finger.

A coloring agent 4 is used to form pattern 3. The coloring agent may comprise a dye, a solvent and nitrocellulose. The dye may preferably be methyl violet. The solvent must be capable of dissolving the dye and the synthetic resin from which the key button body and surface are formed. A ketonic solvent has such capability to dissolve methyl violet dye and ABS resin. Such ketonic solvent may be acetone or isobutyl ketone. The nitrocellulose may be used as a binder for binding the molecules of methyl violet to each other and to the molecules of the ABS resin. The dye, solvent and nitrocellulose may be used in a weight ratio of 1:15:1.

Once pattern 3 of a character of symbol is printed on the working surface 2 of key body 20, with coloring agent 4, such as of the above-mentioned composition, the molecules of methyl violet permeate body 20 including surface 2, accompanying the solvent, as the solvent acts to dissolve the ABS resin of the working surface and body. While the molecules of methyl violet permeate body 20, nitrocellulose binds the molecules of methyl violet to each other and to the ABS resin forming the working surface and body 20.

Advantageously, after the dye permeates the surface 2 and body 20, the body and surface need not be subjected to high temperature drying or curing. Furthermore, high temperature is not required to cause the solvent to dissolve the synthetic resin and cause the dye to permeate the surface and body. In one example, key body 20 was left at room temperature for 20 hours, after pattern 3 was printed on the working surface, and a methyl violet permeated layer of 150 to 200 microns was obtained. The permeation was permanent and a durable surface was formed.

In this embodiment, ABS resin is used as the molding material. It is to be understood, however, that any other suitable synthetic resin may be used as the molding material. Furthermore any suitable dye, other than the methyl violet hereinmentioned, may also be used. Moreover the ketonic solvents hereinmentioned as being suitable for methyl violet and ABS resin, may be replaced with other suitable solvents, provided the solvent used will dissolve the dye used and the synthetic resin used. The binder used is not necessary and other suitable binders may be used. Also, the dye used can be sublimable or not sublimable. It is only necessary that the dye be soluble in the particular solvent used.

A process for manufacturing the inventive key button will now be described with reference to FIGS. 2 and 4A through 4F.

Figure 3:
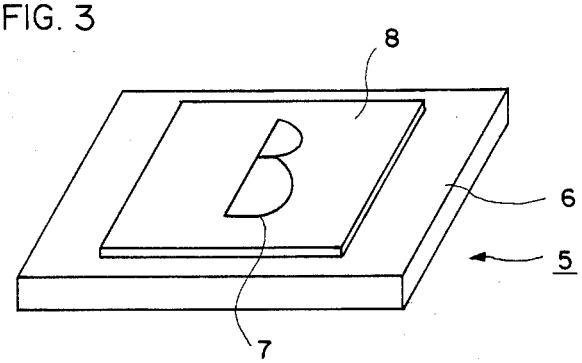
FIG. 3 is a perspective view of a transfer plate.

Referring to FIG. 3, transfer plate 5 comprises a fixed block 6 and a character plate 8 provided with a groove 7 engraved therein, in intaglio, in the form of pattern 3, and mounted on fixed block 6. As illustrated in FIGS. 4A–4F, transfer plate 5 is disposed opposite a printing pad or unit 10. Printing unit 10 is provided at the lower end thereof with a rubber pad 9, formed, for example, of silicon rubber or the like.

Figure 4A:
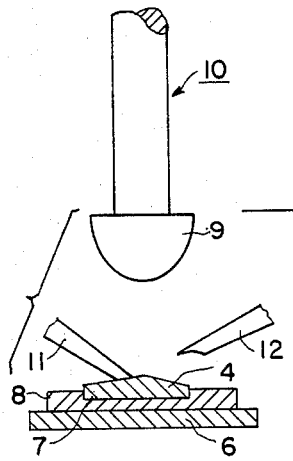
FIGS. 4A through 4F, are schematic illustrations of the steps of manufacture of the invention.
Figure 4B:
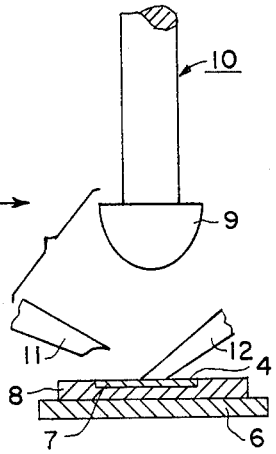
Figure 4C:
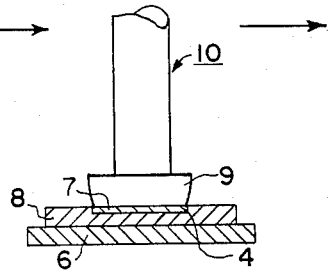
Figure 4D:
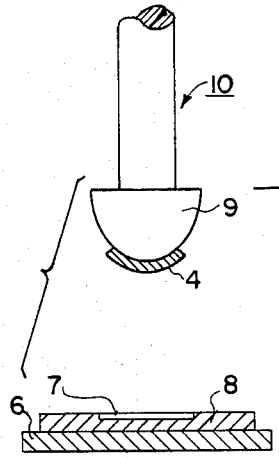
Figure 4E:
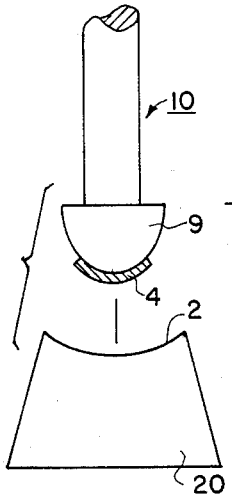
Figure 4F:
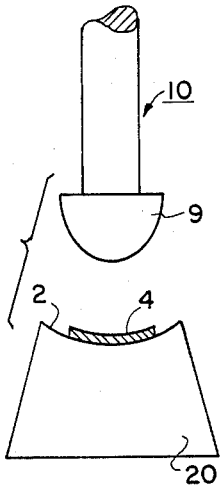

In printing pattern 3 of a character or symbol on top surface 2 of key body 20, by operation of printing unit 10, first, coloring agent 4 is filled in groove 7, formed in character plate 8, with an applicator 11 (as shown in FIG. 4A). Then, excess coloring agent 4 is removed from character plate 8 with a knife 12 (see FIG. 4B). Then, rubber pad 9 of printing unit 10 is pressed against the groove 7 (having coloring agent 4 therein) to cause coloring agent 4 to adhere to the surface of the lower part of rubber pad 9. (See FIGS. 4C and 4D). Then, printing unit 10 is moved to a position opposite top surface 2 of key body 20, which is disposed apart from the plate 5, as depicted. Then, printing unit 10 is pressed against top surface 2 to transfer coloring agent 4 from rubber pad 9 to top surface 2. The coloring agent 4 then adheres to the top surface 2. Printing unit 10 is then removed from the contact with top surface 2. (See FIGS. 4E and 4F). This completes the printing of pattern 3, which may be a character or a symbol, on top surface 2.

As described hereinbefore, the solvent in coloring agent 4 then acts to dissolve the synthetic resin of the key body 20 and top surface 2, to cause the dye contained in the coloring agent 4 to permeate the top surface and the body, and cause the molecules of the dye to bond with each other and with the resin molecules. The thus printed surface is left to stand at room temperature for a suitable period until the dye permeates the surface and body and creates a suitable thickness of layer of the dye in the body, such as 20 hours, as abovementioned. The pattern 3 is thus firmly bonded to surface 2, and is durable and will not readily wear out with use. Advantageously, the key button of this invention may be produced simply and inexpensively.

The foregoing description is illustrative of the principles of the invention. Numerous extensions and modifications thereof would be apparent to the worker skilled in the art. All such extensions and modifications are to be considered to be within the spirit and scope of the invention.

What is claimed is:

1. A key button formed by molding a synthetic resin and provided on a top surface thereof with a character or symbol, wherein said character or symbol is printed on said top surface with a coloring agent comprising methyl violet dye, a nitrocellulose binder and a ketonic solvent, said solvent being capable of dissolving said dye and said synthetic resin, whereby said solvent acts on said synthetic resin to cause said dye to permeate through said top surface and into said button, and said binder acts to bind the molecules of said methyl violet to each other and to the molecules of said synthetic resin, wherein said synthetic resin is acrylonitrile-butadiene-styrene resin.

2. The key button of claim 1, wherein said ketonic solvent is acetone or isobutyl ketone.

3. The key button of claim 1, wherein said methyl violet, ketonic solvent and nitrocellulose are mixed in a weight ratio of 1:15:1.

4. The process of claim 2, wherein said methyl violet, ketonic solvent and nitrocellulose are in a weight ratio of 1:15:1.

5. The process of claim 4, wherein after printing of said character or symbol on said top surface with said coloring matter, said body is left at room temperature for about 20 hours.

6. The process of claim 4, wherein said ketonic solvent is acetone or isobutyl ketone.

7. A process of manufacturing a key button, comprising the steps of molding a resin material into a key body; printing a character or symbol on a top surface of said key body, with a coloring matter comprising methyl violet dye, a nitrocellulose binder and a ketonic solvent, said solvent being capable of dissolving said dye and said resin material; whereby said solvent acts on said resin material on said top surface and in said body, thereby to cause said dye to permeate through said top surface and into said body, with said binder acting to bind the molecules of said dye to each other and to molecules of said resin material; and wherein said resin material is acrylonitrile-butadiene-styrene resin.

* * * * *